United States Patent [19]

Caillier

[11] 4,321,872

[45] Mar. 30, 1982

[54] AUTOMATIC HOPPER UNLOADING DEVICE

[76] Inventor: Edgard H. Caillier, 59263 Houplin, Ancoisne, France

[21] Appl. No.: 949,114

[22] Filed: Oct. 6, 1978

[30] Foreign Application Priority Data

Oct. 7, 1977 [FR] France ..... 7730211

[51] Int. Cl.[3] ..... B61D 7/04; B61D 7/18; B61D 7/32

[52] U.S. Cl. ..... 105/241.2; 414/387

[58] Field of Search ..... 105/361, 241; 414/387

[56] References Cited

U.S. PATENT DOCUMENTS 836,395 11/1906 Moore ..... 105/241 C 3,790,008 2/1974 Joubert ..... 105/241 C

*Primary Examiner*—Richard A. Bertsch

*Attorney, Agent, or Firm*—Darby & Darby

[57] ABSTRACT

Apparatus for automatically unloading a hopper type car having at least one pair of doors whose individual doors swing open in opposite directions, each door having an end of a connecting rod attached thereto so that the rod is moved in the same direction as the doors of a pair are opened. The rod operates a control lever which acts against a return lever which is biased by a spring, the return force of the spring decreasing as the doors move further open such that the doors stay open of their own weight.

15 Claims, 5 Drawing Figures

AUTOMATIC HOPPER UNLOADING DEVICE

Figure 1:
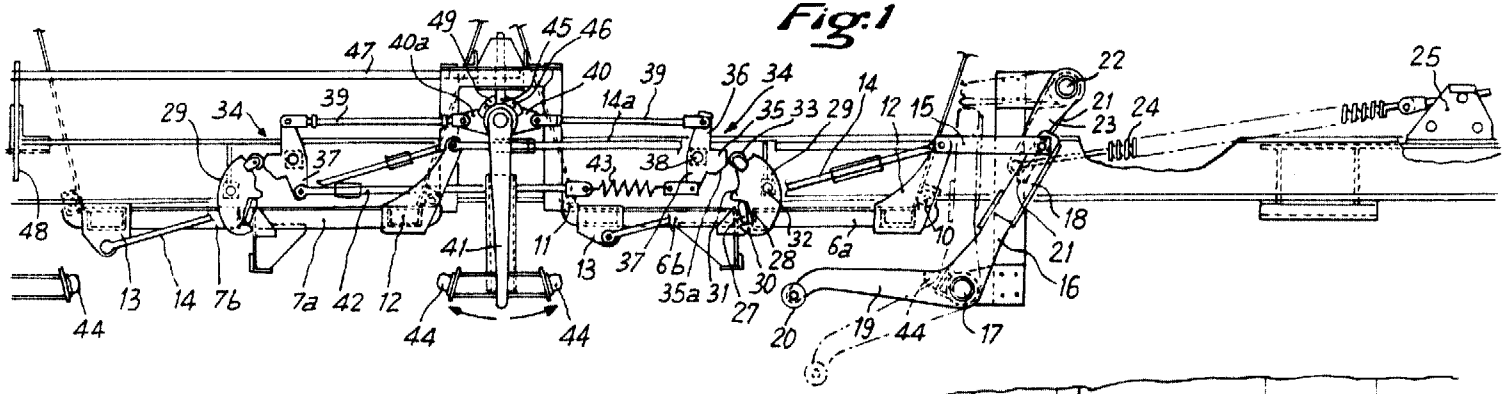

The object of the present invention relates to an automatic hopper unloading device, particularly for hoppers disposed on railroad cars.

Railroad cars designed to carry granular or powdered products, such as coke fines, are provided with hoppers closed at the bottom by swinging doors which are to be opened automatically at a predetermined point on the track so that the product will flow out, and which then are to be reclosed automatically at a second, also predetermined, point.

Closing the bottom of hoppers by means of two doors with horizontal axes perpendicular to the longitudinal axis of the car is known, these two doors being kept in closed position by a locking device actuated by an obstacle placed along the track on which the vehicle rides. The two doors are opened under the influence of the weight of the material contained in the hopper and compress a return device. When the doors reach the fully open position, they actuate a locking device which holds them in this position, enabling the material contained in the hopper to flow out. The car, continuing to move, reaches a second obstacle which releases the lock holding the doors open, so that the latter reclose under the influence of the return member.

In all known devices, the return means allowing the doors to close, are elastic means, such as springs, oleopneumatic jacks or other similar devices, whereof the tension is directly proportional to the degree of opening of the doors. That is, the return devices are at maximum resistance when the doors reach the fully open position. This has many drawbacks. It can happen, as a matter of fact, that if the product is flowing out with difficulty, the doors will not open sufficiently to reach the fully open position in which they become locked by the mechanism provided for holding them open. Since the doors reclose as the weight of the product acting on them diminishes, the hopper is emptied incompletely. The action of the elastic means holding back the doors can sometimes have a retarding effect on the outflow of the product, to the point where it is sometimes necessary to provide mechanisms to vibrate the sides of the hopper in order to complete the unloading. Finally, when the doors are locked in open position, the pressure exerted on them by the elastic means is at a maximum. If the locking means accidentally releases while a workman is scraping the sides of the hopper to finish off an incomplete unloading, he can be very seriously injured by the door suddenly closing.

It is the object of the present invention to eliminate all of the aforesaid drawbacks by disposing a return mechanism in such a way that its resistance to the opening of the doors diminishes, as this opening increases, to a point low enough so that the doors will remain open of their own weight. The mechanism is connected for closing to a control means, actuated by an outside obstacle, which causes the action exerted by the return mechanism to increase until this action reaches a level high enough to overcome the resistance due to the weight of the doors, and reclose them.

The device according to the present invention is formed by at least one pair of doors with horizontal axes, perpendicular to the longitudinal axis of the car. Each door of a pair is equipped with a lever, the levers of the two doors being disposed in opposite directions, and connected to one another by a connecting rod. A control level is provided which is linked by a connecting rod to one of the door levers. A return lever, held back by a spring, is engaged by the said control lever, the position of the return lever relative to the control lever being such that when it pivots under the thrust of the control lever, itself entrained by the doors, the return torque which it exerts on the control lever diminishes until it reaches a lever lower than the torque exerted on the same control lever by the door levers. As this position of the return lever is passed, the doors remain open by the effect of their own weight.

The device also includes a mechanism for locking the doors in raised and closed position. The locking mechanism is actuated by a maneuvering arm that can be actuated either by an operator or by a fixed obstacle disposed at a suitable point.

It is preferable that the locking mechanism itself be made inoperative by a safety lock.

Figure 2:
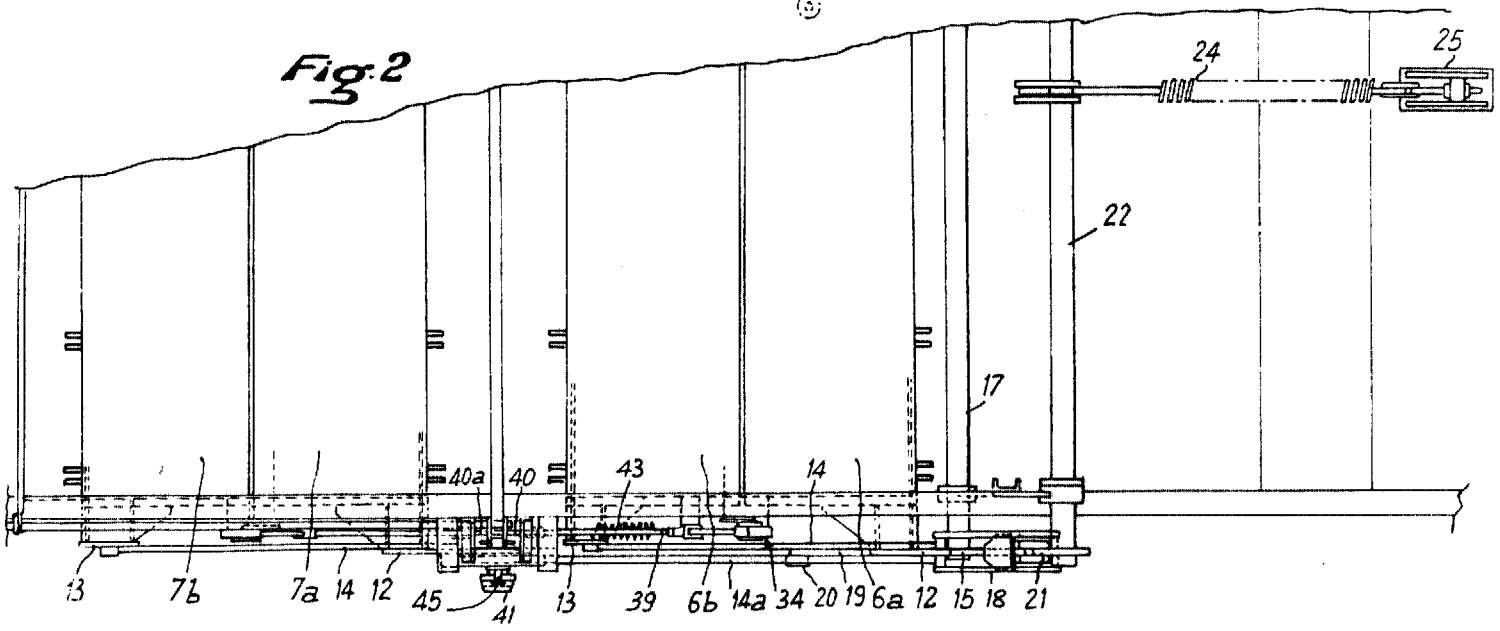
Figure 3:
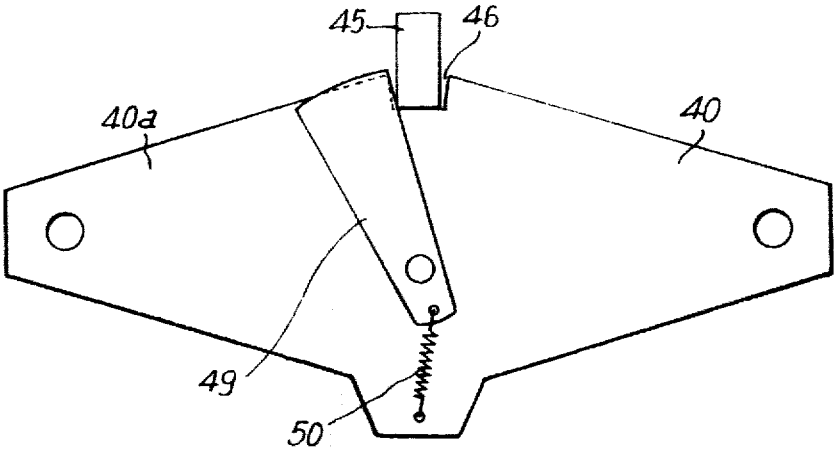
Figure 4:
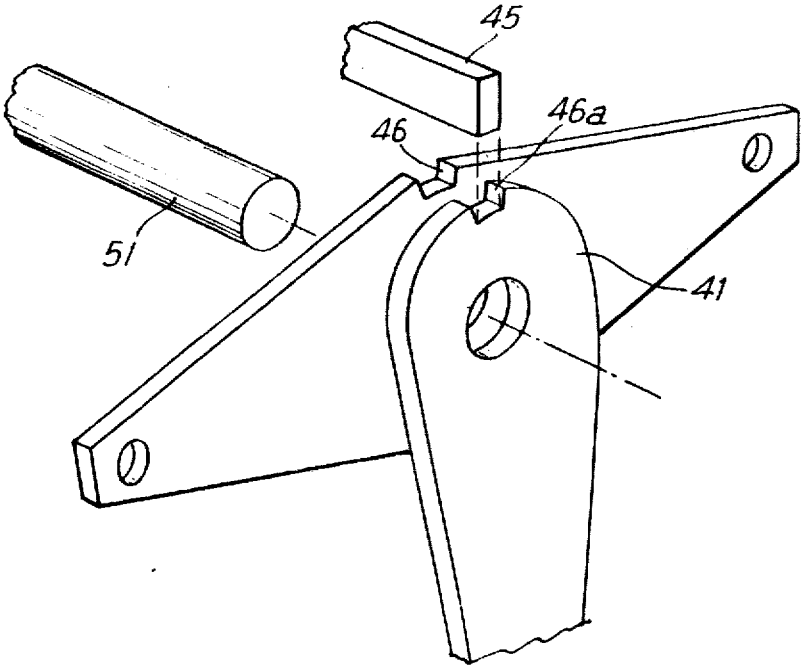

By way of example, and to facilitate comprehension of the invention, the attached drawings show in:

FIG. 1, a view in lateral elevation of a preferred embodiment of the mechanism according to the invention;

FIG. 2, a plan view of FIG. 1;

FIG. 3, an enlarged view of a detail of FIG. 1;

FIG. 4, an exploded view of an alternative embodiment of FIG. 3; and

Figure 5:
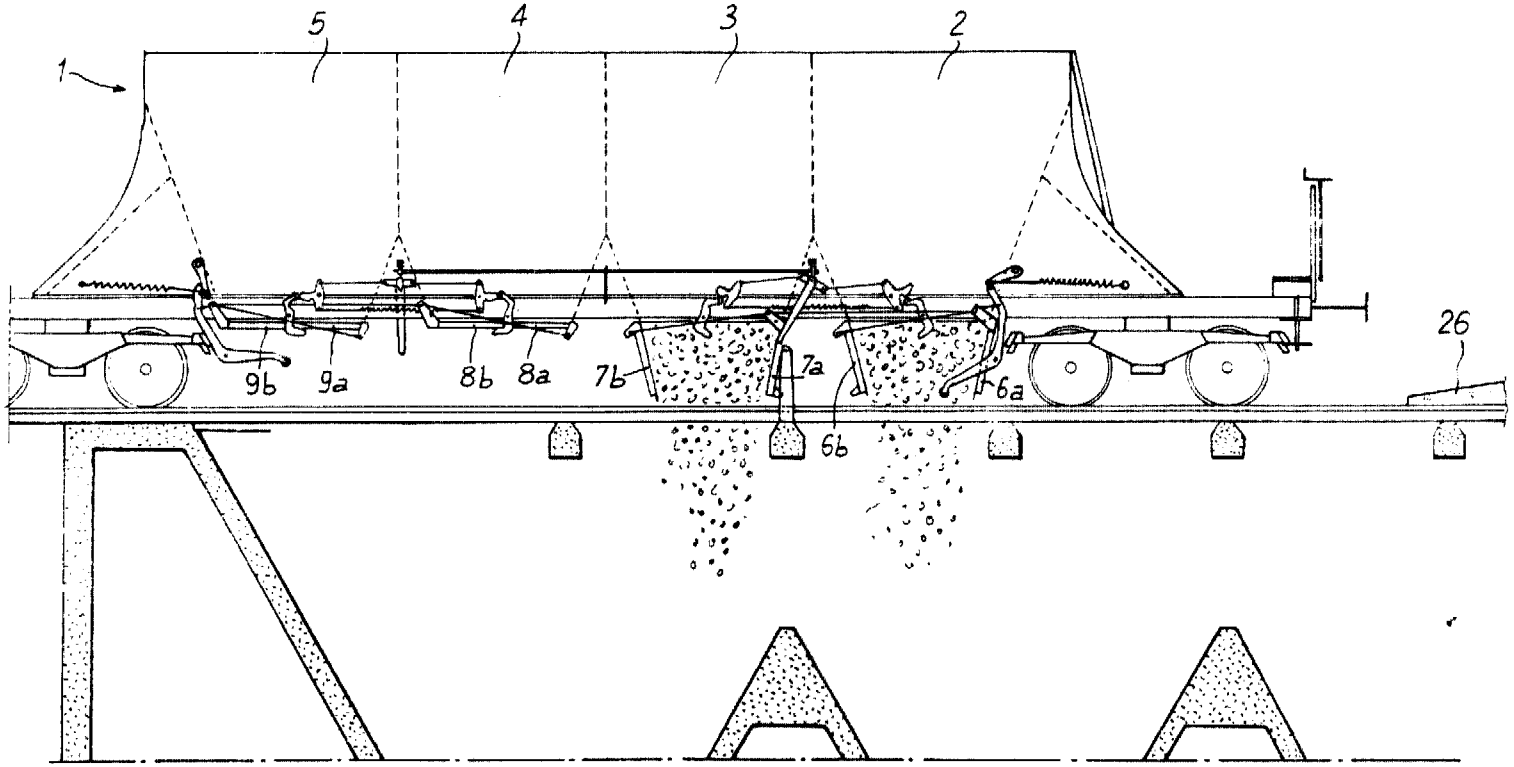

FIG. 5, a diagrammatic view illustrating the automatic unloading of a hopper containing the mechanism according to the invention.

Referring to the drawings, and more particularly to FIG. 5, it is seen that the car 1 has four hoppers 2, 3, 4 and 5, closed at their bottoms by respective pairs of doors 6, 7 8 and 9. The door mechanisms are identical and symmetrical so only one is described in detail.

Door 6*a* of door pair 6 is mounted pivotally on a horizontal axis 10 (FIG. 5), perpendicular to the longitudinal axis of the car 1, and door 6*b* of pair 6 is mounted on a similar axis 11. Door 6*a* is provided with a lever 12 directed upward, door 6*b* is provided with a lever 13 directed downward, and these two levers are linked to one another by a connecting rod 14 disposed diagonally. The length of connecting rod 14 is adjustable.

On the upper end of connecting rod 14, one end of a connecting rod 15 is articulated, the other end being articulated to the upper end of arm 18 of a control lever 16.

The control lever 16 is a bell-crank with two arms, forming an angle between themselves of more than 90°, typically about 120°. At the junction of these two arms, lever 16 is mounted pivotally on an axis 17 parallel to axes 10 and 11. At the end of the lower arm 19 of lever 16, a roller 20 is disposed.

A return lever 21 is urged against the arm 18 of control lever 16. Return lever 21 is connected to a cross-shaft 22, parallel to axes 10, 11 and 17, the shaft 21 itself being connected to a lever 23 that is generally parallel to lever 21 and biased back by a traction spring 24, anchored at 25 on the frame of car 1.

It will be seen that when doors 6*a* and 6*b* are unlocked, they open downward under the influence of the weight of the material stored in hopper 2. The opening movement of the two doors 6*a* and 6*b* is combined by connecting rod 14 so that the two doors simultaneously exert a force on connecting rod 15 causing lever 16 to pivot to the left (counterclockwise) in FIG. 1. The pivoting of lever 16 is effected against the return force of spring 24, which is transmitted to arm 18 of control lever 16 by return lever 21. As lever 16 pivots towards the left, lever 21 is entrained in the same direction as it pivots around the axis of shaft 22. As a result, lever 21 tends to become more and more parallel to spring 24, and hence the leverage of the return torque acting on the end of arm 18 of control lever 16 constantly diminishes. This return torque therefore constantly decreases in magnitude as the doors open, and finally reaches a level such that it is incapable of returning the doors even when hopper 2 is empty and the material no longer forces them to open.

Doors 6*a* and 6*b* therefore remain fully open in a stable position. Their opening is practically instantaneous and they oppose the opening with an elastic resistance of decreasing value. The result, on the one hand, is a much better emptying of the hopper and a stable, fully open position which eliminates any accidental reclosing either before all of the material has flowed out, or when an operator is working inside the opening of the doors.

When the doors are open, the control lever 16 and the return lever 21 occupy the positions represented by the dash lines (FIG. 1).

When roller 20 rolls against an obstacle 26 (FIG. 5) with an gentle slope, arm 19 rises, causing control lever 16 to pivot in a direction opposite to the previous one. Lever 21 drops and the elastic return torque continuously rises until it exceeds the minimum value necessary to overcome the resistance due to the weight of doors 6*a* and 6*b*. The closing then continues in an accelerated manner until the doors are completely closed.

Since levers 12 and 13 are not in the same plane and since connecting rod 14 is adjustable in length, it is possible to combine the door closing movements so that the closing movement of door 6*b* will be somewhat ahead of that of door 6*a*, or vice versa. Thus, there will not be any interference between these closing movements.

Door 6*a* has, at its end, a bar 27 which engages in the opening 28 of a swinging hook 29, this opening 28 being formed between two convex surfaces 30 and 31 on swinging hook 29. Hook 29 is pivotally mounted around an axis 32, parallel to axes 10, 11, 17 and 22 and carries a roller 33 at its end opposite opening 28.

Roller 33 presses against the middle arm 35 of a T-shaped lever 34. Lever 35 has a middle arm 35 and two transverse arms 36 and 37 extending therefrom. Lever 35 is mounted pivotally at the junction point of these three arms on an axis 38 parallel to axis 32.

The end of the upper arm 36 of the T-shaped lever 34 is linked by a connecting rod 39 to a lever 40 which, in the example shown, is connected to a maneuvering lever 41. When maneuvering lever 41 is actuated in one direction or the other, either by an operator or by striking a fixed obstacle disposed beside the track, it moves lever 40 upward or downward and lever 40, through connecting rod 39, exerts force on the T-shaped lever 34. As arm 35 rises, it disengages roller 33. Hook 29 is no longer held and swings downwardly under the force exerted by bar 27, and the doors open.

The car continues to move forward as it is being unloaded, and lever 41 passes by the obstacle which caused it to pivot. Lever 41 moves to its place in unlocked position.

As the doors close, bar 27 strikes convex surface 31, causing hook 29 to swing, roller 33 rolls up against inclined plane 35*a*, causing lever 34 to pivot until it again presses against the end of arm 35, in which position it is aligned with axis 38.

Preferably, as shown in FIGS. 1 and 5, the pairs of doors 6 and 7 of hoppers 2 and 3 are combined so as to open together. The various mechanisms of doors 7*a* and 7*b* are identical and symmetrical to those described above. However, the levers of doors 7*a*, 7*b* are attached to arm 18 of lever 16 by a connecting rod 14*a* serving the same purpose as connecting rod 14. Moreover, connecting rod 39 of the locking mechanism for the doors 7 is controlled by a lever 40*a* symmetrical to lever 40 and connected with the latter. Furthermore, the two lower arms 37 of the two symmetrical levers 34 are linked to one another by a connecting rod 42 containing a spring 43 so that the two levers may swing away from one another under the influence of rollers 33.

The limiting open positions of the doors are defined by rubber stops 44.

In order to prevent an accidental movement of maneuvering lever 41, the latter is immobilized by a safety lock formed by a movable latch 45 (FIG. 3) fitting in a notch 46 formed on the double lever 40–40*a*. The upward swing of latch 45 is controlled by a rod 47 controlled by a handle 48.

Preferably, as shown in FIG. 3, a swinging stop 49, is rotatably mounted on lever 40–40*a*, and returned by a spring 50. It closes on notch 46 when latch 45 is raised, so that once this latch has been raised it can no longer fall back into notch 46, but falls back onto stop 49. The latter, which projects slightly above the upper side of lever 40–40*a*, is retracted laterally when the said lever returns to neutral position, so that latch 45 can return to notch 46.

Thus, when a train composed of hopper cars provided with the automatic unloading device according to the invention, passes before the unloading station, just one man is needed to actuate lever 48, and all the subsequent operations can be effected automatically.

FIG. 4 represents an exploded view on a large scale of an alternative embodiment of the system represented in FIG. 3. It may be preferable to have lever 41 free on its axis and not connected to double lever 40–40*a* when safety mechanism 48 has not been actuated. Thus, if this lever 41 accidentally strikes an obstacle placed along the track, the impact will have no effect on the mechanism.

As shown in FIG. 4, lever 40–40*a* and maneuvering lever 41 are mounted loose on an axis 49 and lever 41 has a notch 46*a* identical to notch 46. Latch 45 is normally in raised position. When latch 45 is lowered by the movement of rod 47, it falls into the two notches 46 and 46*a* and thus connects the two levers 40 and 40*a*.

What is claimed is:

1. A bottom discharge hopper car having a body, a pair of doors pivotally mounted to the bottom of the car body to swing open therefrom, translating means coupled to said pair of doors and moving in response to the opening thereof, return means including elastic biasing means producing a force for closing said doors, means connecting said return means to said translating means, said return means being responsive to the movement of said translating means for reducing the force provided by said elastic biasing means as said doors swing open to a point where the doors stay open of their own weight.

2. A bottom discharge hopper car as in claim 1 wherein said translating means comprises a respective mounting means on each opened door, and a connecting rod connected between said pair of mounting means.

3. A bottom discharge hopper car as in claim 2 wherein said connecting means comprises a control lever movable from a first position to a second position connected to said connecting rod which moves from said first to said second position as the doors swing open, said return means including a return lever which is connected to said biasing means, said control lever engaging said return lever, movement of said control lever from said second to said first position permitting the force exerted by said elastic biasing means to increase until such time as it becomes greater than the torque force exerted by the weight of the doors so that the closing of the doors continues by itself.

4. A bottom discharge hopper car as in claim 1 further comprising means operable in response to the movement of the car for operating said return means to cause the elastic biasing means to act to close the doors.

5. A bottom discharge hopper car as in claim 3 wherein said control lever has an upper arm engaging said return lever, and a lower arm having means thereon which during the displacement of the hopper car is adapted to engage a fixed obstacle on the ground over which the car moves to move the control lever from said second position to said first position.

6. A bottom discharge hopper car as in claim 3 in which the mounting means and connecting rod are located so that one of the doors will close ahead of the other.

7. A bottom discharge hopper car as in claim 6 further comprising a locking bar in one of said doors for engaging in the opening of a locking means mounted to said car body.

8. A bottom discharge hopper car as in claim 7 wherein said locking means includes a swinging hook and further comprising further locking means mounted on said car body, said swinging hook being pivotally mounted on an axis and having an arm, opposite the hook, for engaging said further locking means.

9. A bottom discharge hopper car as in claim 8 wherein said further locking means includes a T-shaped lever means mounted pivotally on an axis situated at the junction of the two cross-arms of the T, the center leg of the T locking the swinging hook, a maneuvering lever connected to the car body, and means for coupling a cross arm of the T to said maneuvering lever.

10. A bottom discharge hopper car as in claim 9 wherein the maneuvering lever is disposed generally vertically on a side of the car body a first lever connected to said maneuvering lever such that rotational movement of said maneuvering lever produces downward or upward movement of said first lever, said first lever being connected to said coupling means which is coupled to the upper cross arm of the T, a movement of said maneuvering lever causing movement of the center leg of the T-shaped lever to release the hook of said swinging locking means.

11. A bottom discharge hopper car as in claim 9 wherein there are two pairs of symmetrical doors each having a T-shaped lever means controlled by a single maneuvering lever placed between two double lever means mounted to the car and connected to said maneuvering lever, a respective cross arm of each of the T-shaped lever means of a respective door pair being linked to said double lever means, the other cross arms of the two T-shaped levers being linked to one another by resilient means enabling them to move elastically away from one another during the locking when the hook of the locking means of a respective door pair pivots the center leg of the respective T-shaped lever.

12. A bottom discharge hopper car as in claim 9 wherein the maneuvering lever is connected to the means for coupling it to the T-shaped lever means and includes safety latch means.

13. A bottom discharge hopper car as in claim 12 wherein said safety latch means comprises a notch formed on said maneuvering lever, safety latch means for location in said notch to prevent movement of the maneuvering lever means and means for moving the safety latch out of said notch.

14. A bottom discharge hopper car as in claim 13 further comprising tilting stop means with which the notch and the latch are associated, a spring for biasing the stop means which closes the notch when the latch is raised, and which is forced to pivot and unmask the notch when the maneuvering lever returns to place after having been actuated.

15. A bottom discharge hopper car as in claim 9 wherein the maneuvering lever and the means for coupling it to the T-shaped lever means are separate from one another, and are both mounted loose on a horizontal axis, each of said maneuvering and T-shaped lever means having a notch at the top thereof, the two notches being aligned side by side, and a swinging latch means for actuation by an operator for falling into the notches and thereby uniting the two lever means.

* * * * *